US006796560B1

(12) United States Patent
Cornelius et al.

(10) Patent No.: US 6,796,560 B1
(45) Date of Patent: Sep. 28, 2004

(54) INTERCONNECTED BLOCK PUZZLE

(76) Inventors: Barbara Cornelius, P O Box 405, Noosa Heads, QLD 4567 (AU); Jonathan Paul Sligh, P O Box 405, Noosa Heads, QLD 4567 (AU)

( * ) Notice: Subject to any disclaimer, the term of this patent is extended or adjusted under 35 U.S.C. 154(b) by 0 days.

(21) Appl. No.: 09/577,146

(22) Filed: May 24, 2000

(30) Foreign Application Priority Data

May 27, 1999 (AU) ..... PQ 0585

(51) Int. Cl.[7] ..... A63F 9/08
(52) U.S. Cl. ..... 273/153 R
(58) Field of Search ..... 273/157 R, 155, 273/153 R

(56) References Cited

U.S. PATENT DOCUMENTS 2,992,829 A * 7/1961 Hopkins
4,323,244 A 4/1982 Busing
4,410,179 A * 10/1983 Rubik
4,722,712 A * 2/1988 McKenna
5,299,804 A * 4/1994 Stevens

FOREIGN PATENT DOCUMENTS

| | | | |
|---|---|---|---|
| AU | 65553/96 | 12/1996 | |
| EP | 1055434 A2 * | 11/2000 | ..... A63F/9/08 |
| GB | 2074459 | 4/1980 | |
| GB | 2111395 | 11/1981 | |

* cited by examiner

*Primary Examiner*—Gregory Vidovich
*Assistant Examiner*—Nini F. Legesse
(74) *Attorney, Agent, or Firm*—Hoffman, Wasson & Gitler

(57) ABSTRACT

An interconnected block puzzle comprises a plurality of blocks, each block being hingedly interconnected to two adjacent blocks, each block having a top face and an opposed bottom face which are partially triangular in shape and an outer end face which interconnects the top face and the bottom face, the end face being curved. The puzzle can adopt curved shapes such as cylindrical, heart and flower petal shapes.

13 Claims, 4 Drawing Sheets

INTERCONNECTED BLOCK PUZZLE

FIELD OF THE INVENTION

This invention relates to a block puzzle and particularly to a block puzzle having a number of blocks hinged together.

BACKGROUND OF THE INVENTION

Interconnected block puzzles are puzzles having a number of blocks (typically six to twelve) which are hinged together. These blocks can adopt a number of different shapes. Some types of block puzzles are purely for entertainment and enjoyment, while other types of block puzzles (for instance the Rubic cube) are also used for skills development.

Conventional block puzzles are shaped and interconnected in a manner which restricts the versatility of the blocks and which restricts the permutations and combinations to relatively few variations.

It is highly desirable to allow an interconnected block puzzle to adopt certain particular shapes and configurations which improve the commercial acceptability and attractiveness of the puzzle. In our earlier international patent application WO 99/10059, there is described an interconnected block puzzle which overcomes some of the disadvantages of restrictions in permutations and combinations. However, in our earlier international patent application, the block puzzle was unable to adopt curved, circular or cylindrical configurations. This placed a limitation on the puzzle as the puzzle could not adopt wheel-like configurations, disc-like configurations, heart shaped configurations, flower configurations and other curved configurations, which placed a limitation on its versatility. For instance, certain types of graphics could not be applied to our previous puzzles as the graphics required a circular or cylindrical puzzle configuration.

Interconnected block puzzles function efficiently only if the blocks remain undamaged and particularly as long as the block edges are not damaged. These block edges can abut other edges in certain configurations and any denting or damage to the edges can cause the puzzle to lose its effectiveness. Block puzzles having side walls formed with right angle edges or otherwise abrupt or sharp edges are particularly vulnerable to damage. For instance, if the puzzle is dropped it is common for the edges to become chipped or damaged.

Most consumers are familiar with the Rubic cube. The Rubic cube has a cuboid configuration, and allows the blocks to be twisted relative to each other. It is found that a consumer will attempt to twist and other type of puzzle block which has a cuboid shape. Thus puzzles which do not have a twist hinge are often damaged. To provide a puzzle where the blocks can align neatly and close to each other in various configurations, it is desirable to use a fine hinge joint. Often, the hinge joint comprises a sticker or other sheet material which extends over two blocks. It is not practical to use very strong hinge joints which resist twisting as these joints are too large. The fine hinge joint is easily damaged or torn if the puzzle is twisted.

The puzzles typically have stickers attached to each face. Often, a sticker is made to extend over two or more faces. For puzzles having only abrupt edges, and particularly having an outer end face which meets with a side face at a sharp edge, the stickers are more prone to becoming worn or to lift on the edge. This is because the outer end faces of the blocks are handled most often and the puzzle is usually picked up and held by gripping the outer end faces. Thus it is highly desirable to be able to reduce wear and damage of the stickers on the outer end faces of the block.

Conventional puzzles can be packaged by shrink wrapping to hold the block pieces together and to protect the puzzle during transportation and prior to sale. It is found that puzzles having sharp outer end edges can break through the wrapping and can be damaged. Thus such puzzles can require most robust and therefore more expensive packaging.

BRIEF SUMMARY OF THE INVENTION

The present invention is directed to an interconnected block puzzle having blocks of a particular design which are formed with an outer face which is curved and which can define part of a circle, the blocks being hinged to adjacent blocks in a particular manner.

In one form, the invention resides in an interconnected block puzzle comprising a plurality of blocks, each block being hingedly interconnected to two adjacent blocks, each block having a top face and an opposed bottom face which are partially triangular in shape and an outer end face which interconnects the top face and the bottom face, the end face being curved and defining part of a circle, the blocks adapted to adopt a cylindrical configuration whereby the top faces of adjacent said blocks are adjacent each other, the bottom faces of adjacent blocks are adjacent each other and the curved outer end face of each block together define a circle.

In another form, the invention resides in an interconnected block puzzle comprising a plurality of blocks, each block being hingedly interconnected to two adjacent blocks, each block having a top face and an opposed bottom face which are partially triangular in shape and an outer end face which interconnects the top face and the bottom face, the end face being curved.

It is preferred that each block is attached to two adjacent blocks along a single hinge line.

Suitably, each block is connected to only two adjacent blocks and the blocks are connected in such a way that the interconnected blocks are able to adopt a planar configuration.

This can be achieved by a hinge which interconnects the top face of a block with the top face of an adjacent block, and a hinge which connects the bottom face of the block with the bottom face of another adjacent block.

This arrangement provides great versatility in the various shapes and configurations that the block puzzle can adopt.

Each block is preferably wedge-shaped with the top face and the bottom face of the block being partially triangular in shape and being planar, the end face of each block being curved and defining part of a circle, each block having two side faces extending between the top face and the bottom face of the block, each side face being planar and the two side faces converging from the end face to a forward edge where the side faces meet.

The blocks are preferably all the same size and shape which can provide greater versatility. A puzzle can be made having at least eight said blocks and it is preferred that the puzzle has exactly eight blocks, the end face of each block defining one-eighth of an arc of a circle.

The blocks may be solid or hollow and may be formed from various suitable materials including plastics, wood, ceramics, metals, and combinations thereof.

The blocks may have patterns and ornamentations applied to the various faces to form decorative arrangements. These arrangements may be such that recognisable figures or certain complimentary decorations are achieved when the block adopts certain configurations.

By having a curved end face, abrupt edges and right angle edges are not formed on any part of the end face which reduces damage to the block. Additionally, the curved end face now allows various block configurations to be achieved which hitherto have not been possible.

In another form, the invention resides in an interconnected block puzzle comprising at least four interconnected blocks, the blocks being approximately of equal size and shape, the shape of each block having a substantially constant cross section, three side faces, an upper face and a lower face, whereby at least one side face has a curved portion and at least some said blocks are hinged to the adjacent blocks, each block having a first hinge line along an edge of the upper face and a second hinge line along an edge of the lower face.

BRIEF DESCRIPTION OF THE DRAWINGS

Embodiments of the invention will be described with reference to the following drawings in which.

DETAILED DESCRIPTION

Figure 1:
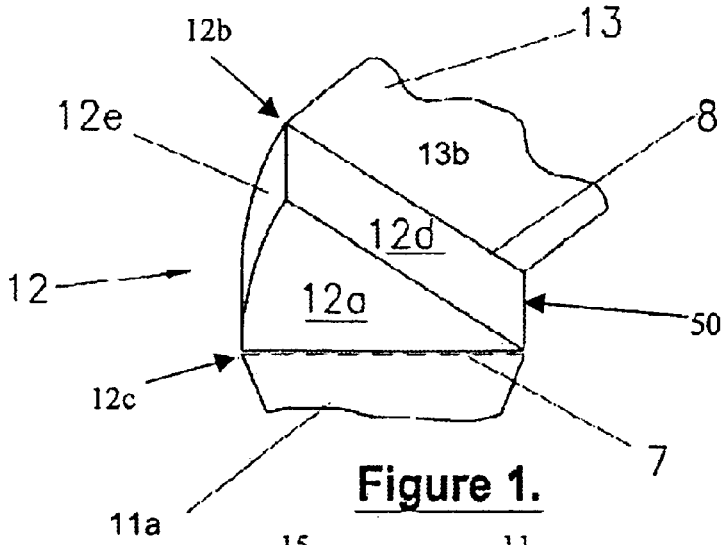
FIG. 1 illustrates a side view of a block and particularly illustrating its method of attachment to two adjacent blocks.

Referring to the figures and initially to FIG. 1, there is illustrated a single block 12 of the block puzzle. Block 12 in FIG. 1 is illustrated on its side and has a substantially wedge-shaped configuration. The block has a top face 12A (see FIG. 2) and a bottom face 12B (see FIG. 3). These two faces are identical and each comprises a planar substantially triangular shape. Block 12 has an outer end face 12E which is smoothly curved and defines part of an arc of a circle. Block 12 has two side faces 12D (illustrated in FIG. 1) and an opposed side face 12C (not illustrated). The side faces are planar and are rectangular and are of identical size. Side faces 12D and 12E converge together from end face 12E to a forward edge 50 where the side faces meet.

Block 12, and all the blocks in the puzzle according to the embodiment, are hingedly attached to two adjacent blocks to enable each block to hinge relative to each of the two adjacent blocks.

The blocks are hinged in a particular manner illustrated in FIG. 1. That is, a particular block (in this instance block 12) is connected to an adjacent block 11 via a single hinge axis, or hinge line 7 which connects the top face 12A of block 12 with the top face 11A of adjacent block 11. The hinge line or hinge axis 7 extends along the edge between top face 12A and the side face 12C (the side face not illustrated but being the side face opposite to side face 12D). Block 12 is hinged to the other adjacent block 13 via a similar type of hinge line or hinge axis which, this time, extends from bottom face 12B and hingedly connects to the bottom face 13B of the other adjacent block 13.

It is the combination of this hinging arrangement together with the curved outer face of each block which provides a surprising and unexpected improvement and versatility to the interconnected block puzzle.

Figure 2:
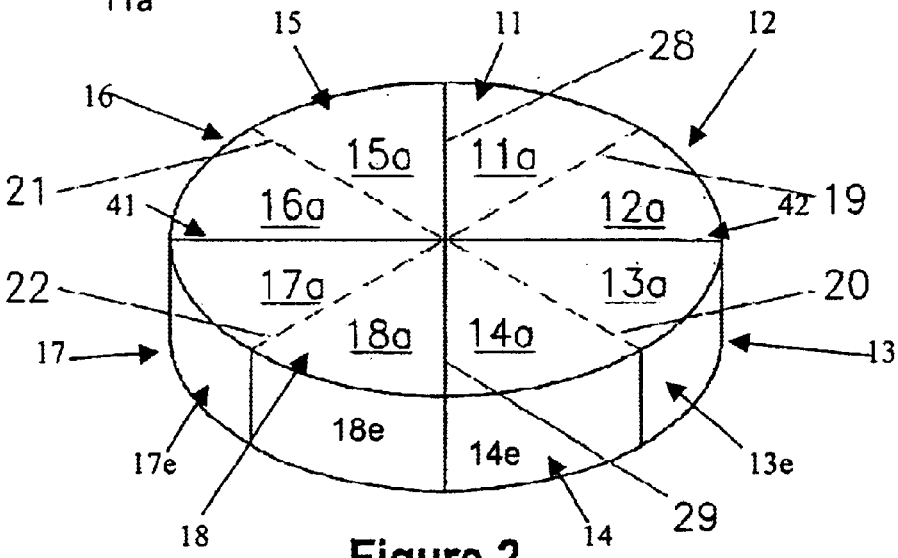
FIG. 2 is a top perspective view of an interconnected block puzzle according to an embodiment of the invention.

FIG. 2 shows a cylindrical block puzzle formed from eight identical blocks 11–18. Each of the blocks is wedge-shaped and has a curved outer face 11E–18E. The curved outer face of each block is identical in size and each curved outer face constitutes one-eighth of an arc of a circle. Each block 11–18 has a top face 11A–18A, an opposed bottom face 11B–18B, the already mentioned end face 11E–18E, and opposed side faces 11C–D–18C–D (the side faces of some of the blocks being illustrated in FIGS. 4 and 5).

The block puzzle illustrated in FIG. 2 has the blocks hinged to two adjacent blocks in a manner described and illustrated with reference to FIG. 1. In FIGS. 2 to 6, the dotted lines indicate fold lines, while the solid lines indicate cut-lines.

With particular reference to FIG. 2, blocks 11 and 12 have top faces 11A and 12A hinged together via hinge line 19. Blocks 13 and 14 have top faces 13A and 14A hinged together by hinge line 20. Blocks 15 and 16 have top faces 15A and 16A hinged together by hinge line 21. Blocks 17 and 18 have top faces 17A and 18A hinged together by hinge line 22.

FIG. 2 illustrates four major cut-lines these being cut-line 28 separating the side faces of blocks 15 and 11, cut-line 42 separating the side faces of blocks 12 and 13, cut-line 29 separating the side faces of blocks 14 and 18, and cut-line 41 separating the side faces of blocks 16 and 17.

Figure 3:
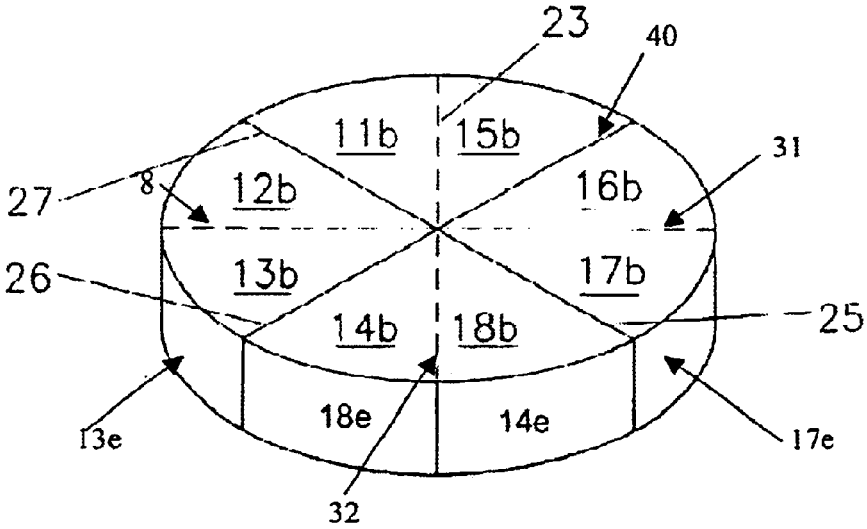
FIG. 3 is the bottom view of the puzzle of FIG. 2.

FIG. 3 is the bottom view of the puzzle of FIG. 2 showing the various bottom faces 11B–18B of blocks 11–18. Bottom faces 11B and 15B are hinged together by hinge line 23, bottom faces 16B and 17B are hinged together by hinge line 31, bottom faces 14B and 18B are hinged together by hinge line 32, and bottom faces 12B and 13B are hinged together by hinge line 18.

The bottom view of the puzzle shows four major cut-lines 25–27 and 40. Cut-line 40 separates the side faces of blocks 15 and 16, cut-line 25 separates the side faces of blocks 17 and 18, cut-line 26 separates the side faces of blocks 13 and 14, and cut-line 27 separates the side faces of blocks 11 and 12.

Each said cut-line terminates in a hinge line. For instance, in FIG. 2, hinge line 21 is at the top of cut-line 40. Hinge line 19 (this being the same as hinge line 7 in FIG. 1) is at the top of cut-line 27. Hinge line 20 is at the top of cut-line 26, and hinge line 22 is at the top of cut-line 25.

Figure 4:
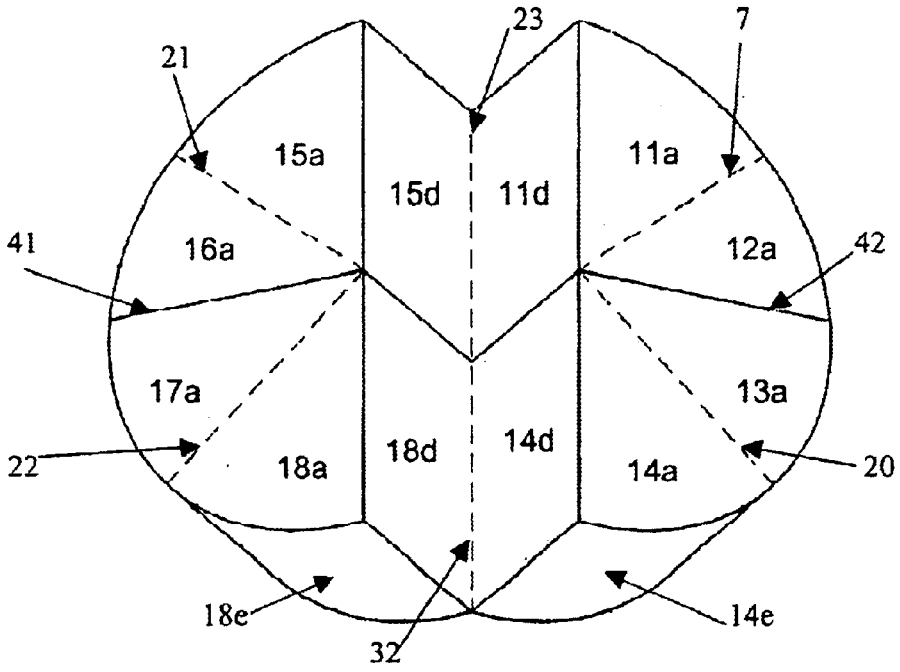
FIG. 4 is a top perspective view of the puzzle of FIG. 2 which has been partially opened along cut-line 28.

FIG. 4 is a top perspective view of the puzzle of FIG. 1 which has been partially opened about cut-lines 29 and 28. In this figure, side faces 18D, 15D, 11D and 14D are illustrated and the bottom hinge lines 32 and 23 are now also illustrated.

Figure 5:
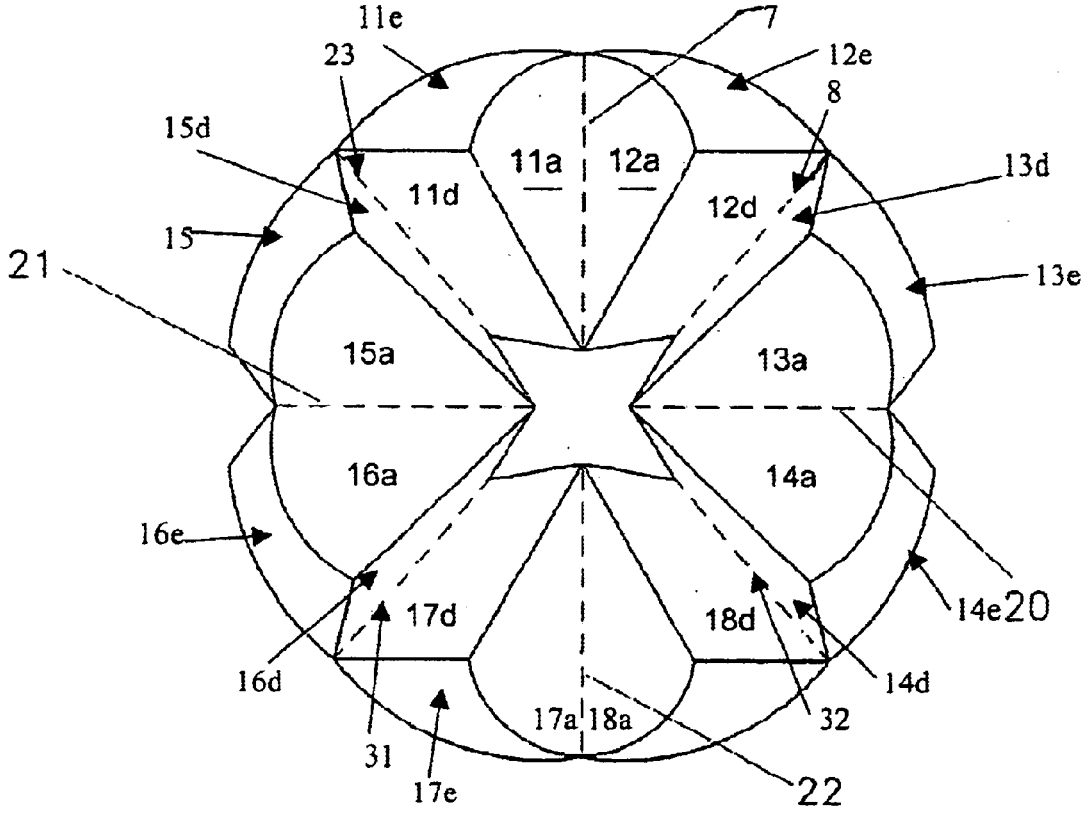
FIG. 5 illustrates the puzzle of FIG. 2 and FIG. 4 which has now been opened more fully along cut-lines 41, 42.

FIG. 5 illustrates the puzzle of FIG. 4 which has also been opened along cut-lines 41 and 42 to allow all the upper faces to be visible.

Figure 6:
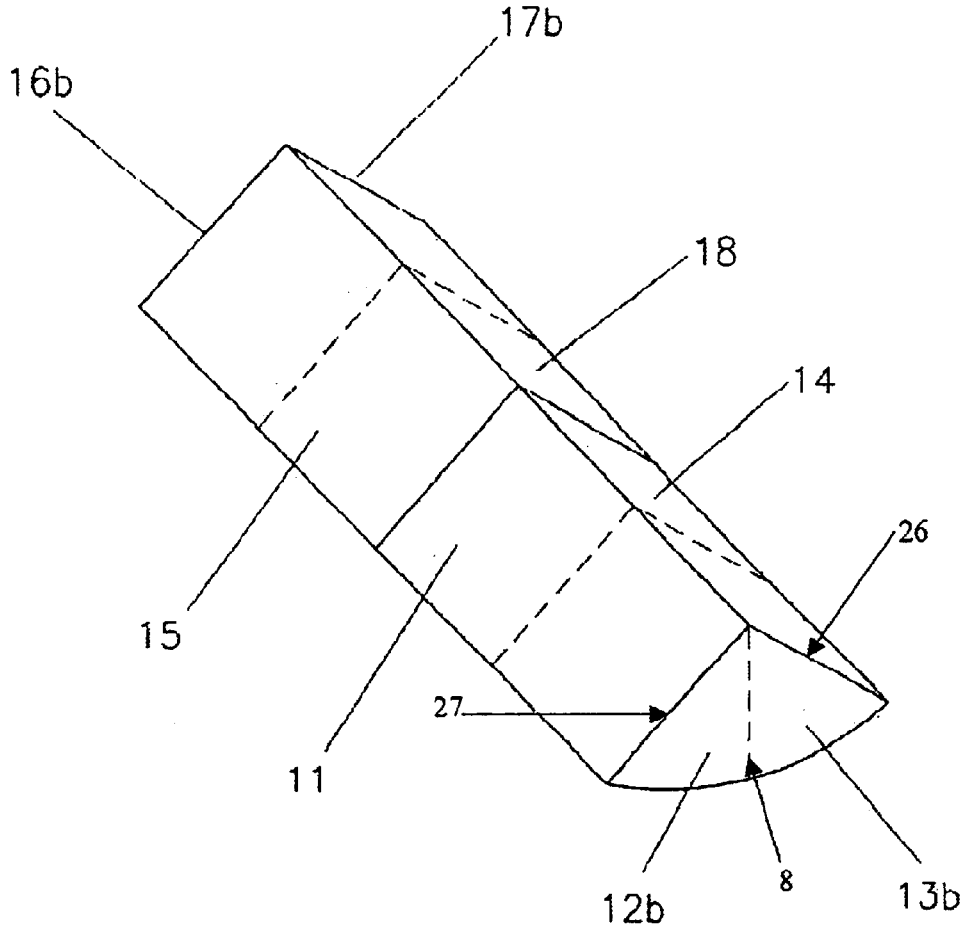
FIG. 6 illustrates an alternative configuration that the puzzle of the embodiment can adopt.

FIG. 6 illustrates a folded alternative where the puzzle can adopt a linear part curved arrangement. In this arrangement, the puzzle can be joined with other puzzles to form a elongate cylindrical puzzle.

Figure 7:
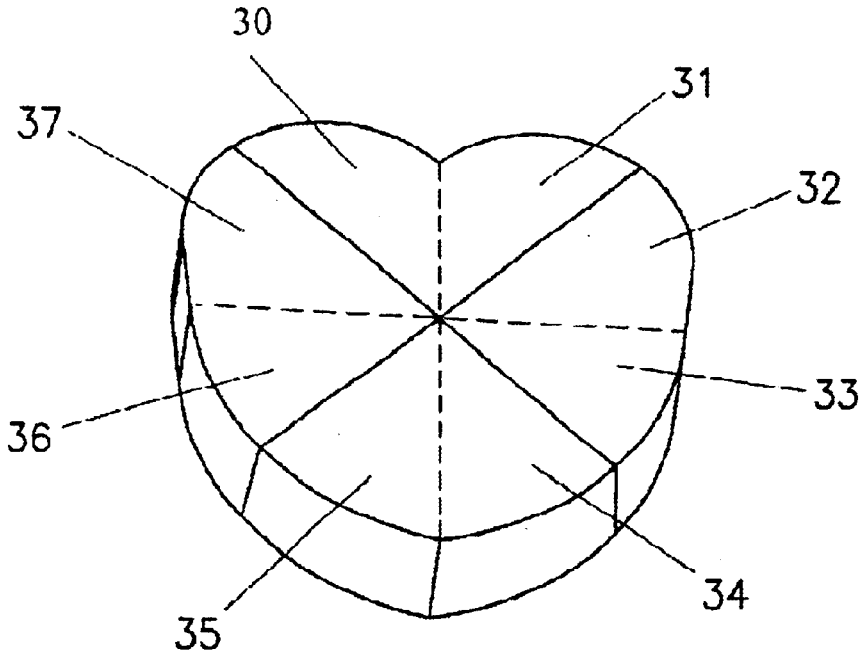
FIG. 7 illustrates a heart shaped puzzle according to a second embodiment.

FIG. 7 illustrates a puzzle according to a second embodiment. The puzzle is heart shaped, and comprises eight block wedges 30–37 similar to that described above. Each wedge has a curved outer face similar to that described above, except that now the degree of curvature is different. For instance the end faces (not illustrated) of blocks 30 and 31 have a tighter curvature, while the end faces of the remaining blocks are more gently curved. This allows a heart shaped puzzle configuration to be adopted. The puzzle has fold lines shown in dotted outline and cut lines shown as solid lines which are identical to that described above.

Figure 8:
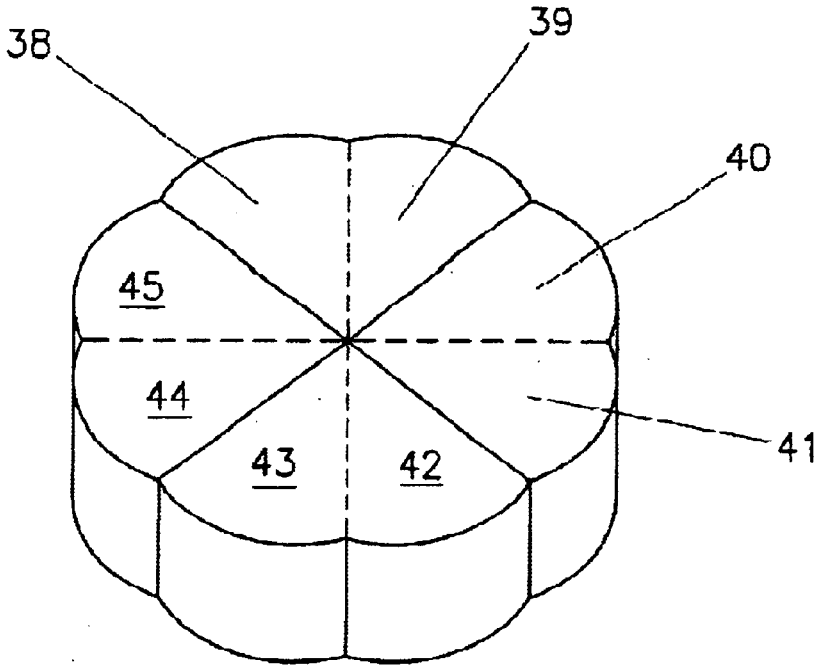
FIG. 8 illustrates a flower petal shaped puzzle according to a third embodiment.

FIG. 8 illustrates a puzzle according to a third embodiment. The puzzle is flower petal shaped, and comprises eight block wedges 38–45 similar to that described above. Each wedge has an identical curved outer face which defines an arc of an imaginary circle which has a diameter less than the distance from one edge of the puzzle to an opposite edge of the puzzle. This allows a petal shaped puzzle configuration to be adopted. The puzzle has fold lines shown in dotted outline and cut lines shown as solid lines which are identical to that described above.

With the large number of permutations and combinations of the hinge lines, the cut-lines, and the particular shape of each of the puzzle blocks, a combination has now been developed which allows circular and cylindrical puzzles to be made having the ability to adopt a large number of different shapes including circular and cylindrical. It being appreciated that for and eight block puzzle, there are eight possible fold lines, eight possible cut-lines, and each block can have from 5 to 6 sides which makes the total number of permutations and combinations extremely large. The present invention has realised that by curving the outer face of the blocks, a surprising and unexpected improvement can be made to the puzzles and the puzzles can find greater versatility in the marketplace.

It should be appreciated that various other changes and modifications can be made to the embodiment described without departing from the spirit and scope of the invention.

What is claimed is:

1. An interconnected block puzzle comprising a plurality of blocks, each said block having three non-negligible dimensions and having a top face and an opposed bottom face which are partially triangular in shape, each top and bottom face having a first and a second edge enclosing an angle, the first edge of the top face being parallel and coplanar with the first edge of the bottom face and an outer end face which interconnects the top face and the bottom face, the end face being curved, each block being hinged to two adjacent blocks by a first hinge line and a second hinge line, the first said hinge line extending on the first edge on the bottom face and hinging the block to a first adjacent block and the second said hinge line extending along the second edge on the top face of the block, the puzzle in its operational form able to adopt an arrangement with a single block thickness and a peripheral curved wall.

2. The puzzle of claim 1, wherein each block is connected to the adjacent block along a single hinge axis.

3. The puzzle of claim 2, wherein each block is connected only to two adjacent blocks, the interconnected blocks able to adopt a planar configuration.

4. The puzzle of claim 3, wherein each block is connected to one said adjacent block by a hinge which interconnects the top face of the block with the top face of the adjacent block, and is connected to the other adjacent block by a hinge which interconnects the bottom face of the block with the bottom face of the other adjacent block.

5. The puzzle of claim 4, wherein each block is wedge-shaped, the top face and the bottom face being partially triangular in shape and being planar, the end face being curved and defining part of a circle, each block additionally having two side faces which extend between the top face and the bottom face, each side face being planar and converging together from the end face to a forward edge where the side faces meet.

6. The puzzle of claim 5, comprising at least eight said blocks.

7. The puzzle of claim 6, comprising eight said blocks.

8. The puzzle of claim 5, wherein the end faces of some of the blocks have a greater degree of curvature than the end faces of other said blocks.

9. The puzzle of claim 8, adapted to adopt a heart shape.

10. An interconnected block puzzle comprising a plurality of blocks, each said block having three non-negligible dimensions and having a top face and an opposed bottom face which are partially triangular in shape, each top and bottom face having a first and a second edge enclosing an angle, the first edge of the top face being parallel and coplanar with the first edge of the bottom face and an outer end face which interconnects the top face and the bottom face, the end face being curved and defining part of a circle, each block being hinged to two adjacent blocks by a first hinge line and a second hinge line, the first said hinge line extending on the first edge on the bottom face and hinging the block to a first adjacent block and the second said hinge line extending along the second edge on the top face of the block, the blocks adapted to adopt a cylindrical configuration whereby the top faces of adjacent said blocks are adjacent each other, the bottom faces of adjacent blocks are adjacent each other and the curved outer end face of each block together define a circle.

11. The puzzle of claim 10, wherein the end face of each block defines an arc of a circle.

12. The puzzle of claim 10, wherein the arc of each block is equal and defines part of an imaginary circle which has a diameter less than the distance from one edge of the puzzle to an opposite edge of the puzzle.

13. An interconnected block puzzle comprising at least four interconnected blocks, the blocks having three non-negligible dimensions and being approximately of equal size and shape, the shape of each block having a substantially constant cross-section, three side faces, an upper face and a lower face, whereby at least one side face has a curved portion, each block being hinged to two adjacent blocks by a first hinge line and a second hinge line, the first said hinge line extending on the first edge on the lower face and hinging the block to a first adjacent block and the second said hinge line extending along the second edge on the upper face of the block.

* * * * *